US006966805B1

(12) United States Patent
Caldwell

(10) Patent No.: US 6,966,805 B1
(45) Date of Patent: Nov. 22, 2005

(54) MARINE TRANSMISSION WITH SYNCHRONIZED ENGAGEMENT OF A DOG CLUTCH

(75) Inventor: Rodney M. Caldwell, Pawnee, OK (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 10/865,611

(22) Filed: Jun. 10, 2004

(51) Int. Cl.[7] ..... B63H 20/14
(52) U.S. Cl. ..... 440/75
(58) Field of Search ..... 440/75

(56) References Cited

U.S. PATENT DOCUMENTS

| | | | | |
|---|---|---|---|---|
| 1,931,288 A | | 10/1933 | Griswold | |
| 2,091,557 A | | 8/1937 | Montgomery | |
| 2,592,695 A | * | 4/1952 | Hindmarch | 192/53.5 |
| 2,741,351 A | * | 4/1956 | Fletcher et al. | 192/218 |
| 2,890,599 A | * | 6/1959 | Sinclair | 74/655 |
| 3,563,354 A | | 2/1971 | Sigg | 192/35 |
| 3,680,409 A | * | 8/1972 | Chamberlain | 475/300 |
| 3,919,964 A | | 11/1975 | Hagen | 115/34 R |
| 4,349,091 A | | 9/1982 | Miyake et al. | 192/53 F |
| 4,811,825 A | | 3/1989 | Christian et al. | 192/53 F |
| 5,170,872 A | | 12/1992 | Salicini | 192/48.2 |
| 5,312,307 A | * | 5/1994 | Reaser | 475/241 |
| 6,062,360 A | | 5/2000 | Shields | 192/21 |
| 6,460,425 B1 | | 10/2002 | Bowen | 74/331 |
| 6,571,654 B2 | | 6/2003 | Forsyth | 74/339 |
| 6,672,180 B2 | | 1/2004 | Forsyth | 74/339 |

* cited by examiner

*Primary Examiner*—Stephen Avila
(74) *Attorney, Agent, or Firm*—William D. Lanyi

(57) ABSTRACT

A marine transmission for connecting a driven shaft to a driving shaft is provided with first and second dog clutch members and first and second friction clutch members which are actuated, respectively, by first and second hydraulically actuated devices. Engagement of the friction clutch members with each other creates rotation in the driven shaft that approaches or equals the rotational speed of the driving shaft so that subsequent engagement of the first and second dog clutch members can be accomplished without significant relative rotational speed differences between the two dog clutch members.

17 Claims, 1 Drawing Sheet

MARINE TRANSMISSION WITH SYNCHRONIZED ENGAGEMENT OF A DOG CLUTCH

BACKGROUND OF THE INVENTION

1. Field of the Invention

The present invention relates generally to a dog clutch transmission for a marine vessel and, more particularly, to a marine transmission which incorporates both friction and dog clutch mechanisms in cooperation with hydraulic actuators that at least partially synchronize the rotational speed of a driving shaft and a driven shaft prior to engagement of the dog clutch elements.

2. Description of the Prior Art

Dog clutches of various types are well known to those skilled in the art and are used in many different variations of marine transmissions.

U.S. Pat. No. 1,931,288 which was granted to Griswold on Oct. 17, 1933, describes a transmission with an improved device for synchronizing the gear elements and in which the operation of the synchronizing clutches are affected through rotating parts not subjected to high relative speeds.

U.S. Pat. No. 2,091,557, which was granted to Montgomery on Aug. 31, 1937, describes a marine power transmission with a clutch housing located between an engine and the transom of a marine vessel. This application is intended to adapt high speed automotive or industrial-type engines to marine use.

U.S. Pat. No. 3,563,354, which issued to Sigg on Feb. 16, 1971, describes an automatically engaging and disengaging dog clutch. The dog clutch is disposed between an input shaft and an output shaft and includes a first straight-toothed clutch boss, a second helical-tooth clutch boss, an axially slidable clutch spider and a synchronizing sleeve which is retained against axial movement in the clutch spider.

U.S. Pat. No. 3,919,964, which issued to Hagen on Nov. 18, 1975, describes a marine propulsion reversing transmission with a hydraulic assist. The transmission is located in a propulsion unit and connected to a drive shaft and to a propeller shaft. It is shiftable between neutral, forward drive, and rearward drive conditions.

U.S. Pat. No. 4,349,091, which issued to Miyake et al. on Sep. 14, 1982, describes a synchronized dog clutch. It comprises a clutch shaft, a coupling sleeve splined to the clutch shaft and dog claws at its end. A synchronizer ring is slidably fitted to the outer periphery of the coupling sleeve and has a conical face for friction engagement.

U.S. Pat. No. 4,811,825, which issued to Christian et al. on Mar. 14, 1989, describes a dog clutch with locking synchronization. A synchronizer body and a gear turning with a different rotational speed are coupled together with the aid of an axially displaceable, annularly shaped sliding sleeve when synchronized.

U.S. Pat. No. 5,170,872, which issued to Salicini on Dec. 15, 1992, describes a synchronizer for activating and deactivating a dog clutch, particularly in article wrapping machines. The outputs of a pair of intermittence devices operated in phase with a clutch driving shaft is described. Electromagnetic friction clutches allow outputs to be connected to the driven disc of the clutch.

U.S. Pat. No. 6,062,360, which issued to Shields on May 16, 2000, discloses a synchronizer for a gear shift mechanism for a marine propulsion system. A synchronized gear shift mechanism is provided for a marine propulsion system. Using a hub and a sleeve that are axially movable relative to an output shaft but rotationally fixed to the shaft and to each other, the gear shift mechanism uses associated friction surfaces to bring the output shaft up to a speed that is in synchronism with the selected forward or reverse gear prior to mating associated gear tooth surfaces together to transmit torque from an input shaft to an output shaft. The friction surfaces on the forward and reverse gears can be replaced to facilitate repair after the friction surfaces experience wear.

U.S. Pat. No. 6,460,425, which issued Bowen on Oct. 8, 2002, describes a twin clutch automated transmission. The transmission includes a first engine clutch operable to establish a releasable drive connection between the engine and a first input shaft, a second engine clutch operable to establish a releasable drive connection between the engine and a second input shaft, an output shaft and a gear trained for selectively establishing a plurality of forward and reverse speed ratio drive connections between the input shafts and the output shaft.

U.S. Pat. No. 6,672,180, which issued to Forsyth on Jan. 6, 2004, describes a manual transmission with upshift and downshift synchronization clutches. An automated multi-speed transmission includes an engine clutch operable to establish a releasable drive connection between the engine and an input shaft, an output shaft adapted to transfer power to the drive line, and a synchromesh gear train having a plurality of constant mesh gear sets that can be selectively engaged to establish a plurality of forward and reverse speed ratios.

U.S. Pat. No. 6,571,654, which issued to Forsyth on Jun. 3, 2003, describes an automated manual transmission with upshift ball ramp synchronizer clutch and downshift ball ramp synchronizer clutch. The transmission includes an engine clutch operable to establish a releasable drive connection between the engine and an input shaft, an output shaft adapted to transfer power to the drive line, and a synchromesh gear train having a plurality of constant mesh gear sets that can be selectively engaged to establish a plurality of forward and reverse gear speed ratios.

The patents described above are hereby expressly incorporated by reference in the description of the present invention.

In marine transmissions, dog clutches are commonly used to connect a driving shaft to a driven shaft in either a forward or reverse direction. It would be helpful and beneficial if a marine transmission could provide a means for diminishing the impact during initial contact between dog clutch surfaces that creates a noise when the transmission is shifted from neutral to either forward or reverse gears.

SUMMARY OF THE INVENTION

A marine transmission made in accordance with a preferred embodiment of the present invention comprises a driving shaft and a driven shaft, a first dog clutch member and a second dog clutch member, a first friction clutch member and a second friction clutch member, a first hydraulically actuated device configured to cause the first and second friction clutch members to move into torque transmitting relation with each other and a second hydraulically actuated device configured to cause the first and second dog clutch members to move into torque transmitting relation with each other.

BRIEF DESCRIPTION OF THE DRAWINGS

The present invention will be more fully and clearly understood from a reading of the description of the preferred embodiment in conjunction with the drawing, in which.

DESCRIPTION OF THE PREFERRED EMBODIMENT

Figure 1:
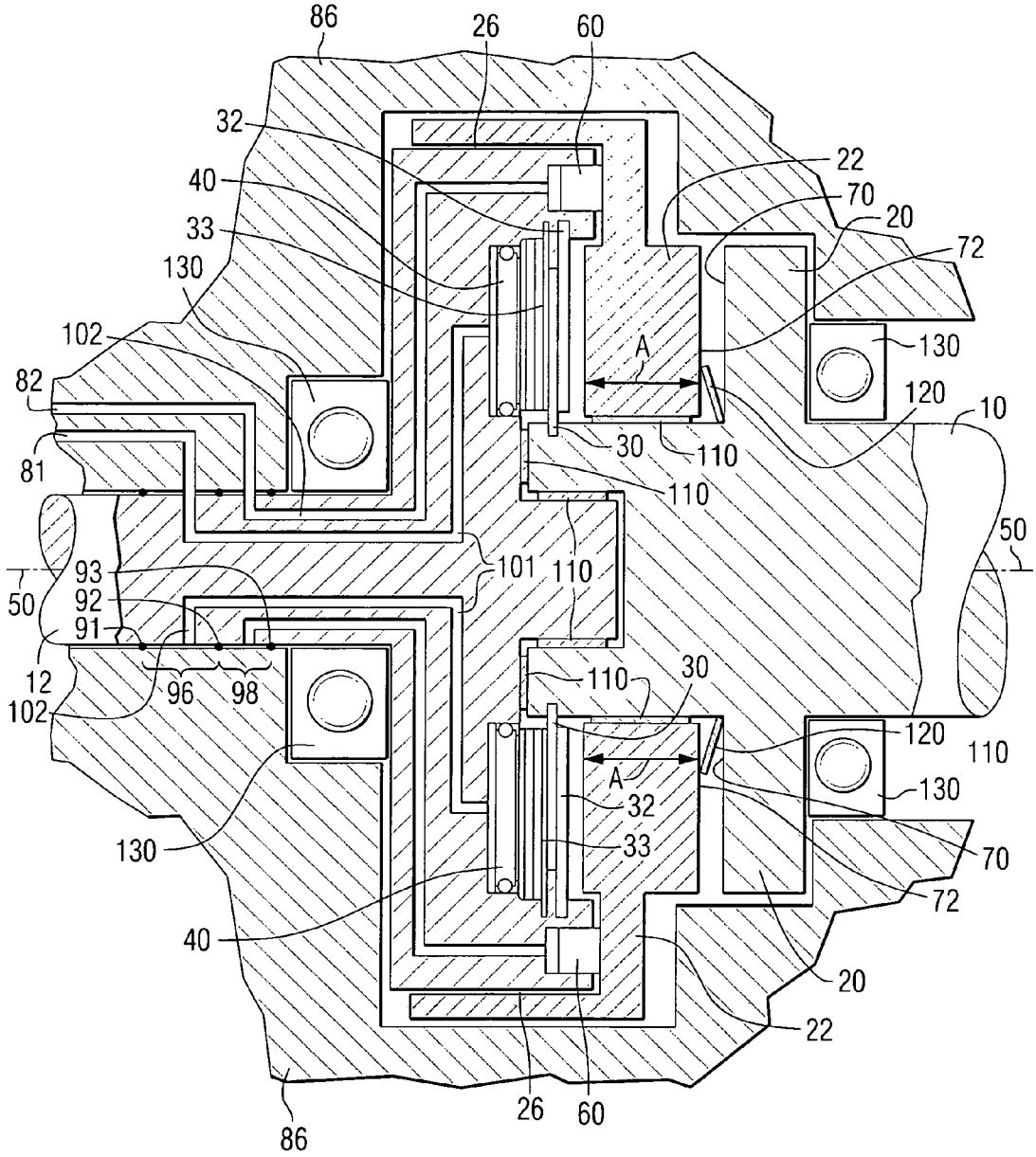
FIG. 1 is a section view of the marine transmission of the present invention.

FIG. 1 is a section view taken through a transmission in a preferred embodiment of the present invention along a central axis of its driving and driven shafts. A driving shaft 10 is connectable in torque transmitting association with a source of motive power, such as an engine. A driven shaft 12 is connectable in torque transmitting association with a propulsor, such as a propeller system of a sterndrive apparatus. A first dog clutch member 20 is shown attached to the driving shaft 10. A second dog clutch member 22 is shown slidably attached to the driven shaft 12 by a configuration of axial splines which are identified by reference numeral 26. Arrow A illustrates the possible axial motion of the second dog clutch member 22 which is made possible by the use of the splines 26 which connect the second dog clutch member 22 to the driven shaft 12 in such a way that the second dog clutch member 22 rotates in unison with the driven shaft 12, but is able to slide axially relative to the driven shaft 12, as indicated by arrow A.

With continued reference to FIG. 1, a first friction clutch member 30 is attached to the driving shaft 10. A second friction clutch member 32 is attached to the driven shaft 12. In the illustration shown in FIG. 1, the second friction clutch member actually comprises two backing plates which are identified by reference numerals 32 and 33. A first hydraulically actuated device 40 is configured to cause the first and second friction clutch members, 30 and 32, to move into torque transmitting contact with each other. In other words, when the first hydraulically actuated device 40 pushes the backing plates, 32 and 33, of the second friction clutch member together, they move into frictional torque transmitting association with the first friction clutch member 30 which is disposed between them. Since the first friction clutch member 30 is attached to the driving shaft 10 and the second friction clutch member 32 (along with backing plate 33) are attached to the driven shaft 12 the frictional contact between these friction clutch members transmits torque between the driving shaft 10 and the driven shaft 12. Although it is not intended that this frictional connection be sufficient to transmit the full torque from the engine to the propulsor under all conditions, it is sufficient to cause the driven shaft 12 to begin to rotate about its axis of rotation 50.

With continued reference to FIG. 1, a second hydraulically actuated device 60 is configured to cause the first and second dog clutch members, 20 and 22, to move into torque transmitting contact with each other. In other words, when the second hydraulically actuated device 60 is energized with hydraulic pressure, it pushes the second dog clutch member 22 toward the right in FIG. 1 and engages it with the first dog clutch member 20. Although not shown in the section view of FIG. 1, it should be understood that mating dog clutch teeth are provided on surface 70 of the first dog clutch member 20 and on surface 72 of the second dog clutch member 22. When these two faces move toward each other and into contact with each other, torque can be transferred directly from the driving shaft 10 to the second dog clutch member 22 and, through the splines 26, to the driven shaft 12.

In the preferred embodiment of the present invention illustrated in FIG. 1, the axis of the driving and driven shafts, 10 and 12, are coaxial with each other. This coaxial relationship is identified by reference numeral 50.

Although two pistons are shown in FIG. 1 to represent the second hydraulically actuated device, it should be understood that typically three or more pistons would be disposed around a circular path and contained within the driven shaft 12 in a preferred embodiment. Similarly, although two pistons are shown in FIG. 1 to represent the first hydraulically actuated device 40, three or more pistons would typically be distributed evenly around a circumferential pattern which is generally coaxial with axis 50. A first port 81 is provided in the housing portion 86 of the transmission to conduct hydraulic fluid to the first hydraulically actuated device 40. A second port 82 is used to conduct hydraulic fluid to the second hydraulically actuated device 60. Seals 91–93 are located between the outer cylindrical surface of the driven shaft 12 and the inner cylindrical surface in the housing 86 through which the driven shaft extends. These seals, 91–93, define first and second hydraulic fluid passages, 96 and 98, which extend annularly around the outer surface of the driven shaft 12 between the seals, 91–93. This allows hydraulic fluid to be conducted from the first port 81 and through conduit 101 to the first hydraulically actuated device 40, which can comprise a plurality of individual pistons spaced around the driven shaft 12. The second conduit 102 allows the second port 82 to be connected in fluid communication with the second hydraulically actuated device 60 to provide hydraulic fluid to those pistons. It should also be understood that the first and second hydraulically actuated devices could be annularly shaped pistons that are coaxial with the shafts and concentric with axis 50. Either individually spaced pistons or single annular pistons can be used as either the first or second hydraulically actuated devices, or both. The specific shapes of the hydraulically actuated devices are not limiting to the present invention.

With continued reference to FIG. 1, a plurality of bearings 110 are provided between various surfaces of the driving shaft 10, the driven shaft 12, and the second dog clutch member 22. A spring 12 is provided to urge the second dog clutch member 22 toward the left in FIG. 1 against the actuated movement of the second hydraulically actuated device 60. Ball bearings 130 are provided to support the driving and driven shafts, 10 and 12, relative to the housing 86.

In operation, when connection of the driving and driven shafts, 10 and 12, is desired, the first hydraulically actuated device 40 is initially actuated by introduction of hydraulic fluid pressure at the first port 81 which causes the plurality of pistons of the first hydraulically actuated device 40 to move the second friction clutch members, 32 and 33, into contact with the first friction clutch member 30. This transmits a certain degree of torque through the first and second friction clutch members and, as a result, causes the driven shaft 12 to begin to rotate. When the driven shaft 12 is rotating sufficiently fast to provide a satisfactory degree of synchronization between the driving and driven shafts, 10 and 12, the second hydraulically actuated device 60 is actuated by introducing hydraulic fluid under pressure at the second port 82 to energize the plurality of pistons of the second hydraulically actuated device 60. This causes the second dog clutch member 22 to move toward the right against the force of the spring 120 and into engagement with the first dog clutch member 20 as the two opposing dog clutch tooth surfaces, 70 and 72, move toward each other. When these surfaces engage each other, torque is transmitted from the driving shaft 10 through the first and second dog clutch members, 20 and 22, to the driven shaft 12 through the spline connection 26. At this time, the first hydraulically actuated device 40 can be relaxed by decreasing the pressure in conduit 101.

As described above, the second dog clutch member 22 is slidably attached to the driven shaft 12 by a configuration of axial splines 26. The first hydraulically actuated device 40 comprises a first plurality of hydraulically actuated pistons supported for rotation by the driven shaft 12 in a particularly preferred embodiment of the present invention. However, it should be understood that alternative embodiments of the present invention could incorporate the first hydraulically actuated device 40 as part of the driving shaft. Similarly, the positions and functions of the first and second dog clutch members, 20 and 22, can be reversed. In a preferred embodiment of the present invention, the first and second hydraulically actuated devices, 40 and 60, are independently operable to actuate the first and second friction clutch members and the first and second dog clutch members, respectively.

By connecting the driving and driven shafts, 10 and 12, in torque transmitting association with each other through the first and second friction clutch members, rotational synchronization can be obtained between the driving and driven shafts prior to engagement of the opposing dog clutch surfaces, 70 and 72. Therefore, when the second dog clutch member 22 is moved toward the right in FIG. 1 to engage the first dog clutch member 20, little or no relative rotational speed should exist between those mating dog clutch teeth on surfaces 70 and 72.

In a preferred embodiment of the present invention, the speed of actuation of the hydraulically actuated devices can be moderated in response to changes in temperature. In other words, when the hydraulic fluid is cold, and therefore more viscous, the speed of actuation of the first hydraulically actuated device can accommodate this condition to avoid a high impact contact between the dog clutch teeth. As a result, the speed of actuation of the two hydraulically actuated devices can be controlled to avoid high impact shifting of the dog clutch under many different temperature conditions.

Although the present invention has been described in significant detail and illustrated to show a preferred embodiment, it should be understood that the relationships and positions of its components can be alternatively positioned on other devices. In other words, the first and second hydraulically actuated devices, 40 and 42, can be attached and supported by the driving shaft 10 rather than the driven shaft 12 in alternative embodiments. Similarly, the first and second friction clutch members can be reversed in their association with the driving and driven shafts. The number of pistons used in both the first and second hydraulically actuated devices, 40 and 60, are not limiting to the present invention. Although the present invention has been described in particular detail and illustrated to show a particularly preferred embodiment, it should be understood that alternative embodiments are also within its scope.

I claim:

1. A marine transmission, comprising:

a driving shaft;

a driven shaft;

a first dog clutch member;

a second dog clutch member;

a first friction clutch member attached to said driving shaft;

a second friction clutch member attached to said driven shaft;

a first hydraulically actuated device configured to cause said first and second friction clutch members to move into torque transmitting relation with each other; and a second hydraulically actuated device configured to cause said first and second dog clutch members to move into torque transmitting relation with each other, said second hydraulically actuated device comprising a second plurality of hydraulically actuated pistons supported for rotation by said driven shaft.

2. The marine transmission of claim 1, wherein:

said driving shaft and said driven shaft are coaxial.

3. The marine transmission of claim 1, wherein:

said first dog clutch member is attached to said driving shaft.

4. The marine transmission of claim 1, wherein:

said second dog clutch member is slidably attached to said driven shaft by a configuration of axial splines.

5. The marine transmission of claim 1, wherein:

said first hydraulically actuated device comprises a first plurality of hydraulically actuated pistons supported for rotation by said driven shaft.

6. The marine transmission of claim 1, wherein:

said first and second hydraulically actuated devices are independently operable to actuate said first and second friction clutch members and said first and second dog clutch members, respectively.

7. The marine transmission of claim 1, further comprising:

a first hydraulic conduit formed at least partially through a first portion of said driven shaft and connected in fluid communication with said first hydraulically actuated device.

8. The marine transmission of claim 1, further comprising:

a second hydraulic conduit formed at least partially through a second portion of said driven shaft and connected in fluid communication with said second hydraulically actuated device.

9. The marine transmission of claim 1, further comprising:

a resilient member configured to provide a first force which urges said first and second dog clutch members apart, said second hydraulically actuated device being configured to exert a second force in a direction which is opposite to said first force.

10. A marine transmission, comprising:

a driving shaft;

a driven shaft, said driven shaft being coaxial with said driving shaft;

a first dog clutch member;

a second dog clutch member, said first and second dog clutch members being supported for rotation about a common axis;

a first friction clutch member attached to said driving shaft;

a second friction clutch member attached to said driven shaft;

a first hydraulically actuated device configured to cause said first and second friction clutch members to move into torque transmitting relation with each other, said first hydraulically actuated device comprising a first plurality of hydraulically actuated pistons supported for rotation by said driven shaft; and a second hydraulically actuated device configured to cause said first and second dog clutch members to move into torque transmitting relation with each other.

11. The marine transmission of claim 10, wherein:

said first dog clutch member is attached to said driving shaft and said second dog clutch member is slidably attached to said driven shaft by a configuration of axial splines.

12. The marine transmission of claim 11, wherein:

said second hydraulically actuated device comprises a second plurality of hydraulically actuated pistons supported for rotation by said driven shaft.

13. The marine transmission of claim 12, wherein:

said first and second hydraulically actuated devices are independently operable to actuate said first and second friction clutch members and said first and second dog clutch members, respectively.

14. The marine transmission of claim 13, further comprising:

a first hydraulic conduit formed at least partially through a first portion of said driven shaft and connected in fluid communication with said first hydraulically actuated device; and a second hydraulic conduit formed at least partially through a second portion of said driven shaft and connected in fluid communication with said second hydraulically actuated device.

15. The marine transmission of claim 14, further comprising:

a resilient member configured to provide a first force which urges said first and second dog clutch members apart, said second hydraulically actuated device being configured to exert a second force in a direction which is opposite to said first force.

16. A marine transmission, comprising:

a driving shaft;

a driven shaft, said driven shaft being coaxial with said driving shaft;

a first dog clutch member;

a second dog clutch member, said first and second dog clutch members being supported for rotation about a common axis;

a first friction clutch member attached to said driving shaft;

a second friction clutch member attached to said driven shaft;

a first hydraulically actuated device configured to cause said first and second friction clutch members to move into torque transmitting relation with each other;

a second hydraulically actuated device configured to cause said first and second dog clutch members to move into torque transmitting relation with each other;

a resilient member configured to provide a first force which urges said first and second dog clutch members apart, said second hydraulically actuated device being configured to exert a second force in a direction which is opposite to said first force;

a first hydraulic conduit formed at least partially through a first portion of said driven shaft and connected in fluid communication with said first hydraulically actuated device; and a second hydraulic conduit formed at least partially through a second portion of said driven shaft and connected in fluid communication with said second hydraulically actuated device, said first hydraulically actuated device comprising a first plurality of hydraulically actuated pistons supported for rotation by said driven shaft and said second hydraulically actuated device comprising a second plurality of hydraulically actuated pistons supported for rotation by said driven shaft, said first and second hydraulically actuated devices being independently operable to actuate said first and second friction clutch members and said first and second dog clutch members, respectively.

17. The marine transmission of claim 16, wherein:

said first dog clutch member is attached to said driving shaft and said second dog clutch member is slidably attached to said driven shaft by a configuration of axial splines.

* * * * *